US010887702B2

(12) United States Patent
Ueno et al.

(10) Patent No.: US 10,887,702 B2
(45) Date of Patent: Jan. 5, 2021

(54) LOUDSPEAKER

(71) Applicant: CLARION CO., LTD., Saitama (JP)

(72) Inventors: Minoru Ueno, Saitama (JP); Takao Ishikawa, Saitama (JP); Fumiaki Nakashima, Saitama (JP)

(73) Assignee: CLARION CO., LTD., Saitama (JP)

( * ) Notice: Subject to any disclaimer, the term of this patent is extended or adjusted under 35 U.S.C. 154(b) by 0 days.

(21) Appl. No.: 16/609,257

(22) PCT Filed: May 8, 2018

(86) PCT No.: PCT/JP2018/017781
§ 371 (c)(1),
(2) Date: Oct. 29, 2019

(87) PCT Pub. No.: WO2019/003646
PCT Pub. Date: Jan. 3, 2019

(65) Prior Publication Data

US 2020/0053481 A1 Feb. 13, 2020

(30) Foreign Application Priority Data

Jun. 28, 2017 (JP) ..... 2017-125809

(51) Int. Cl.
*H04R 25/00* (2006.01)
*H04R 9/06* (2006.01)
(Continued)

(52) U.S. Cl.
CPC ..... *H04R 9/06* (2013.01); *H04R 7/18* (2013.01); *H04R 9/025* (2013.01); *H04R 9/046* (2013.01); *H04R 2400/11* (2013.01)

(58) Field of Classification Search
CPC . H04R 9/06; H04R 9/025; H04R 7/18; H04R 1/06; H04R 2400/11
(Continued)

(56) References Cited

U.S. PATENT DOCUMENTS 5,832,096 A 11/1998 Hall
2003/0103643 A1 6/2003 Yu
(Continued)

FOREIGN PATENT DOCUMENTS

CN 201025732 Y 2/2008
CN 101766035 A 6/2010
(Continued)

OTHER PUBLICATIONS

International Preliminary Report issued for the International Application No. PCT/JP2018/017781 dated Jan. 9, 2020.
(Continued)

*Primary Examiner* — Phylesha Dabney
(74) *Attorney, Agent, or Firm* — IP Business Solutions, LLC

(57) ABSTRACT

To make it possible to take countermeasures against noises of a loudspeaker by means of a simple configuration. A loudspeaker 10 includes: a bobbin 15 that is provided with a voice coil 31; a diaphragm 13 that is connected to the bobbin 15; a frame 11 that supports the diaphragm 13; and a magnetic circuit section 17 that includes a magnet 22. The loudspeaker 10 further includes: a first conductive body 41 that is connected to the voice coil 31 and is led out to the outside of a bobbin 15A; and a second conductive body 51 that is connected to the first conductive body 41 and penetrates the magnet 22.

9 Claims, 8 Drawing Sheets

(51) Int. Cl.

| | |
|---|---|
| ***H04R 7/18*** | (2006.01) |
| ***H04R 9/02*** | (2006.01) |
| ***H04R 9/04*** | (2006.01) |

(58) Field of Classification Search
USPC ..... 381/398
See application file for complete search history.

(56) References Cited

U.S. PATENT DOCUMENTS

| | | | |
|---|---|---|---|
| 2010/0203918 | A1 | 8/2010 | Watanabe |
| 2014/0105427 | A1 | 4/2014 | Watanabe |
| 2016/0286318 | A1 | 9/2016 | Yuasa et al. |
| 2016/0360305 | A1 | 12/2016 | Watanabe |
| 2016/0381446 | A1 | 12/2016 | Huang et al. |
| 2020/0112781 | A1 | 4/2020 | Watanabe |
| 2020/0169797 | A1 | 5/2020 | Huang et al. |

FOREIGN PATENT DOCUMENTS

| | | | |
|---|---|---|---|
| CN | 103987005 | U | 8/2014 |
| CN | 104378722 | A | 2/2015 |
| CN | 204795584 | U | 11/2015 |
| CN | 204948337 | U | 1/2016 |
| JP | 57-196698 | A | 12/1982 |
| JP | 10-322794 | A | 12/1998 |
| JP | 2002-271894 | A | 9/2002 |
| JP | 2015-080121 | A | 4/2015 |
| JP | 2015-126463 | A | 7/2015 |
| WO | 2015/129232 | A1 | 9/2015 |

OTHER PUBLICATIONS

International Search Report for corresponding International Patent Application No. PCT/JP2018/017781 dated Jun. 26, 2018.

Written Opinion for corresponding International Patent Application No. PCT/JP2018/017781 dated Jun. 14, 2018.

Chinese Office Action mailed by Chinese Patent Office dated Aug. 12, 2020 in corresponding Chinese patent application No. 2018800432603.

LOUDSPEAKER

TECHNICAL FIELD

The present invention relates to a loudspeaker.

BACKGROUND ART

A loudspeaker, which includes a bobbin provided with a voice coil, a diaphragm connected to the bobbin, a frame supporting the diaphragm, and a magnetic circuit section including a magnet, is known. This type of loudspeaker is known to have such a configuration that a terminal which is electrically connected with a voice coil is included and a signal line (part of a loudspeaker line) for connecting the loudspeaker and an amplifier is soldered directly on a terminal from the outside of the loudspeaker or is connected by a connector (for example, Patent Literature 1).

In addition, as this type of loudspeaker, a so-called full digital loudspeaker is proposed which includes a plurality of voice coils and obtains, by supply of a predetermined digital signal to each of the voice coils, a sufficient loudspeaker driving force by adding a magnetic field formed by each of the voice coils (for example, Patent Literature 2).

CITATION LIST

Patent Literature

Patent Literature 1
Japanese Patent Laid-Open No. 2015-080121
Patent Literature 2
Japanese Patent Laid-Open No. 2015-126463

SUMMARY OF INVENTION

Technical Problem

For wiring on the loudspeaker side, especially for internal wiring, flexibility and lightweight properties are required; and therefore, wiring having a twisted structure or the like that is suitable for noise countermeasures cannot be used.

Therefore, if a high-frequency noise that causes unnecessary radiation is input to a wiring on the loudspeaker side through a loudspeaker line, an electronic apparatus around the loudspeaker may malfunction. Especially when a digital signal is used, countermeasures against a higher frequency noise are important.

As the countermeasure, a method of mounting a ferrite core for noise countermeasures can be considered. However, this method causes an increase in the number of parts and further generates a necessity to secure an arrangement space of the ferrite core, thereby making the structure complicated.

Therefore, it is an object of the present invention to make it possible to take countermeasures against noises of a loudspeaker by means of a simple configuration.

Solution to Problem

The present description includes the entire contents of Japanese Patent Application No. 2017-125809 filed on Jun. 28, 2017.

In order to achieve the above-mentioned object, one aspect of the present invention provides a loudspeaker that includes a bobbin provided with a voice coil, a diaphragm connected to the bobbin, a frame supporting the diaphragm, and a magnetic circuit section including a magnet, in which the loudspeaker further includes a first conductive body connected to the voice coil and led out to an outside of the bobbin, and a second conductive body connected to the first conductive body and penetrating the magnet.

In the above configuration, the second conductive body may be a coated electric wire covered with a coating having an insulating property. In addition, in the above configuration, the second conductive body may be wound around the magnet in the number of windings with one or more turns.

In addition, in the above configuration, the magnet may be provided with: a through hole through which the bobbin passes; and a groove part which is recessed from the through hole to an outer peripheral side and through which the second conductive body passes. In addition, instead of the groove part, a hole part which is independent of the through hole and through which the second conductive body passes may be provided.

In addition, in the above configuration, the magnetic circuit section may include laminated components which are laminated on the magnet and the second conductive body may pass through the laminated components.

In addition, in the above configuration, the laminated components may include: a plate which is laminated on a front surface side of the loudspeaker with respect to the magnet; and a bottom plate which is laminated on a rear surface side of the loudspeaker; and the plate may be provided with: a hole part through which the bobbin passes; and an independent through hole which does not communicate with this hole part and through which the second conductive body passes; and the bottom plate may be provided with: a notch which is recessed from an outer peripheral surface of the bottom plate to an inner peripheral side and through which the second conductive body passes.

In addition, in the above configuration, a signal which is passed through the second conductive body may be a digital signal.

Further, in the above configuration, the bobbin may include a multilayer voice coil in which a plurality of the voice coils are provided; from the bobbin, a plurality of the first conductive bodies which are respectively connected to the voice coils may be led out at intervals in a circumferential direction; and a plurality of the second conductive bodies which are respectively connected to the first conductive bodies may pass through the magnet at intervals in the circumferential direction of the bobbin.

Advantageous Effects of Invention

One aspect of the present invention includes: the first conductive body which is connected to the voice coil and is led out to an outside of the bobbin; and the second conductive body which is connected to the first conductive body and penetrates the magnet included in the magnetic circuit section; and therefore, can remove a high frequency noise flowing through the second conductive body by using the magnet included in the magnetic circuit section, thereby allowing noise countermeasures of the loudspeaker by means of a simple configuration.

DESCRIPTION OF EMBODIMENTS

Hereinafter, embodiments of the present invention will be described with reference to drawings.

First Embodiment

Figure 1:
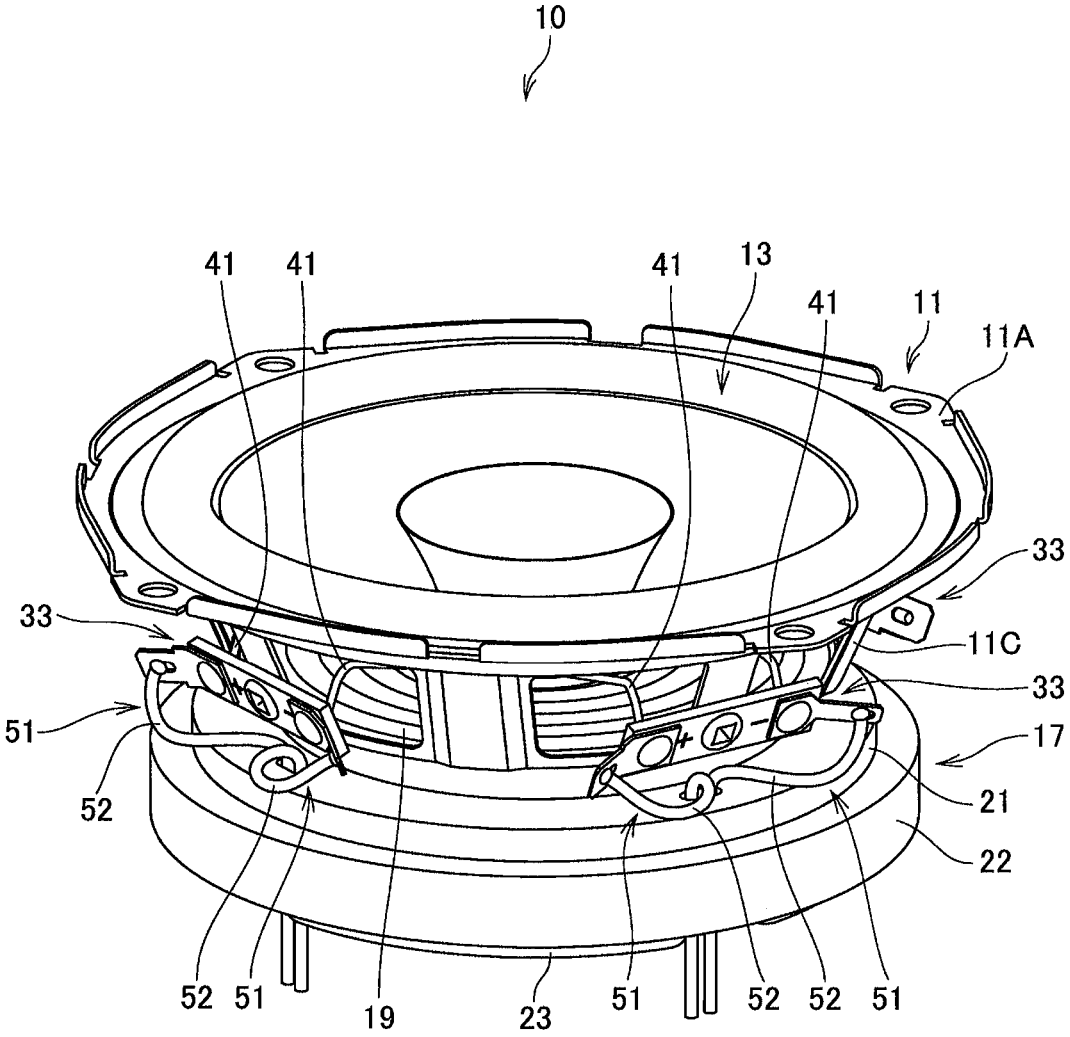
FIG. 1 is a perspective view of a loudspeaker according to a first embodiment.
Figure 2:
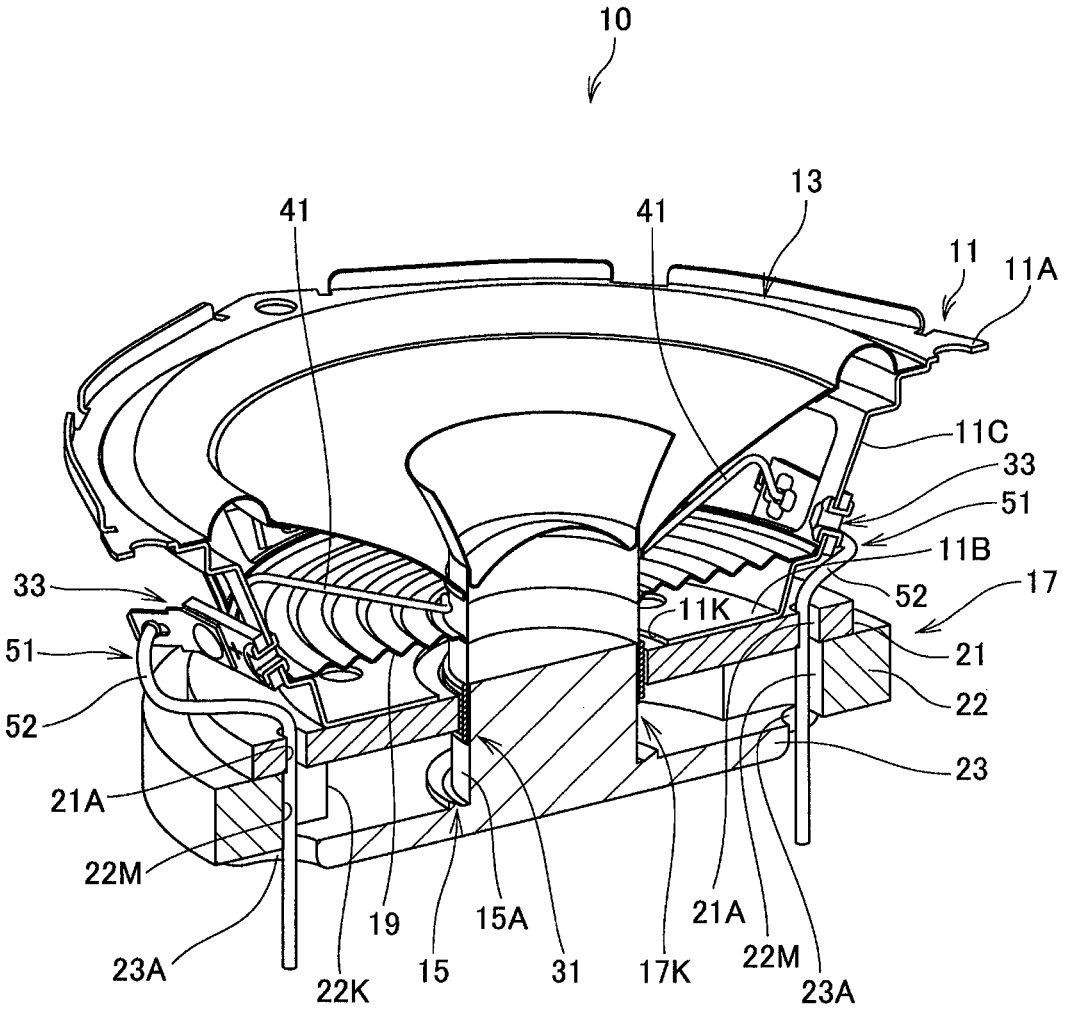
FIG. 2 is a cross-sectional view of the loudspeaker.

FIG. 1 is a perspective view of a loudspeaker 10 according to a first embodiment. FIG. 2 is a cross-sectional view of the loudspeaker 10. FIG. 1 and FIG. 2 show a state in which a front surface of the loudspeaker 10 is arranged so as to be directed upward.

The loudspeaker 10 is an on-vehicle digital loudspeaker which is mounted on a vehicle door, etc., receives a digital signal as an input from a device mounted on a vehicle, and outputs a sound based on this digital signal. As shown in FIG. 1 and FIG. 2, this loudspeaker 10 includes a loudspeaker frame 11 whose front surface is open; and a diaphragm 13, voice coil bobbin 15, and magnetic circuit section 17, which constitute loudspeaker components, are supported by this loudspeaker frame 11.

The loudspeaker frame 11 integrally includes: an annular front frame 11A that is positioned at a frontmost surface of the loudspeaker 10; a disk-shaped bottom frame 11B that is positioned on a rear surface side of the loudspeaker 10; and a plurality of bridge frames 11C that connect the front frame 11A and the bottom frame 11B at intervals in a circumferential direction. The loudspeaker frame 11 is formed of a material having rigidity; and in this configuration, is formed of a metal material.

On the front frame 11A, an outer peripheral part of the diaphragm 13 is mounted. An inner peripheral part of the diaphragm 13 is connected to the voice coil bobbin 15. Between a rear surface of the diaphragm 13 and the bottom frame 11B, a damper 19 that connects the voice coil bobbin 15 and the loudspeaker frame 11 is provided. The damper 19 holds the position of the voice coil bobbin 15 and performs amplitude limitation.

As shown in FIG. 2, on the bottom frame 11B, a through hole 11K through which the voice coil bobbin 15 passes is formed; and on a rear surface of this bottom frame 11B, the magnetic circuit section 17 is mounted.

The magnetic circuit section 17 has a structure in which from a front surface side of the loudspeaker toward a rear surface side, a plate 21 (also referred to as a top plate), a magnet 22, and a bottom plate 23 (also referred to as a yoke) are laminated in order.

In the magnetic circuit section 17, the magnet 22 is sandwiched by the plate 21 and the bottom plate 23 and the voice coil bobbin 15 is arranged in a centrally provided hole part 17K. The plate 21 and the bottom plate 23 are formed by a magnetic material. The magnet 22 is configured by magnetizing a ferrite core of an approximate doughnut shape; for example, it is configured by a ferromagnetic ferrite magnet.

The voice coil bobbin 15 is of a multilayer voice coil bobbin in which a plurality of (four, in the present configuration) voice coils 31 are laminated on a single bobbin 15A. Each of the voice coils 31 is configured by a copper wire excellent in flexibility and lightweight properties; and first conductive bodies 41 corresponding to both end parts of the copper wire are led out to an outside of the bobbin 15A.

In the loudspeaker frame 11, a plurality of (four, in the present configuration) terminal blocks 33, to which the first conductive bodies 41 are respectively connected, are provided at intervals (at equal angular (90 degree) intervals in the present configuration) in a circumferential direction of the loudspeaker 10. In this way, each pair of the first conductive bodies 41 which are connected to an identical one of the voice coils 31 is led out to the outside of the bobbin 15A at equal angular intervals and is connected to each of the terminal blocks 33.

Each of the terminal blocks 33 is configured by a metal plate, etc. and is mounted on the bridge frame 11C of the loudspeaker frame 11 from an outer peripheral side. In addition, on a rear surface side of each of the terminal blocks 33 (corresponding to an inner peripheral side of the loudspeaker 10), each of the plurality of first conductive bodies 41 which extend from the voice coil bobbin 15 is connected. The terminal blocks 33 are provided with the same number as the voice coils 31; and to each of the terminal blocks 33, a pair of the first conductive bodies 41 which extend from an identical one of the voice coils 31 is connected.

To each of the terminal blocks 33, each pair of second conductive bodies 51 is connected from an outer peripheral side of the loudspeaker 10. The pair of second conductive bodies 51 is respectively connected to a pair of the first conductive bodies 41 that are connected to the respective terminal blocks 33; and is externally supplied with a digital signal.

Thus, each of the terminal blocks 33 functions as a relay member for relaying connection between a pair of the first conductive bodies 41 and a pair of the second conductive bodies 51. It should be noted that for a method for connecting the conductive bodies 41 and 51 to the terminal blocks 33, a publicly known method such as soldering can be widely applied.

In the present embodiment, for each of the second conductive bodies 51, a coated electric wire 52 in which a coating having an insulating property is covered around a core wire is applied. For example, one end of this coated electric wire 52 is connected to a predetermined device that outputs a digital signal and another end is connected to the terminal block 33 of the loudspeaker 10, thereby constituting a so-called loudspeaker cable that extends over between the predetermined device and the loudspeaker 10.

As shown in FIG. 2, the coated electric wire 52 is led out from the terminal block 33; penetrates the plate 21, magnet 22, and bottom plate 23 in order which constitute the magnetic circuit section 17; and is led out to the rear surface side of the loudspeaker 10. In other words, in connecting the coated electric wire 52 to the loudspeaker 10, the coated electric wire 52 is connected such that a tip of the coated electric wire 52, which penetrates the magnetic circuit section 17 from the rear surface side of the loudspeaker 10 and is exposed to a front surface side of the magnetic circuit section 17, is connected to the terminal block 33.

Figure 3:
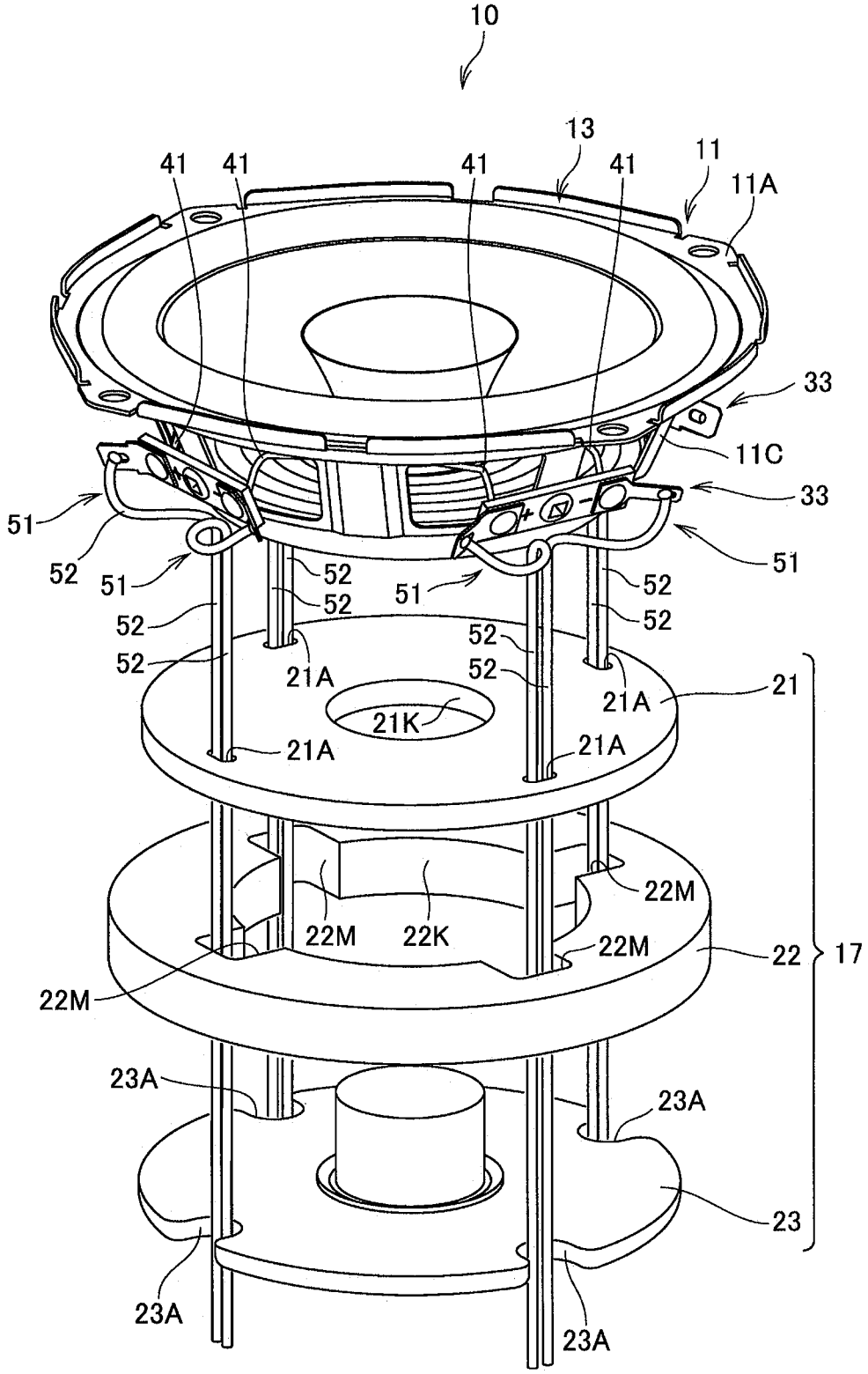
FIG. 3 is a diagram showing the loudspeaker in a state in which components of the magnetic circuit section are separated.

FIG. 3 is a diagram showing the loudspeaker 10 in a state in which components of the magnetic circuit section 17 are separated.

The plate 21 is laminated in a front surface side of the loudspeaker 10 with respect to the magnet 22, and the bottom plate 23 is laminated on a rear surface side of the loudspeaker 10 with respect to the magnet 22. That is, the plate 21 and the bottom plate 23 are laminated components which are laminated on the magnet 22. In addition, the plate 21 and the bottom plate 23 are joined to the magnet 22 with an adhesive or the like.

The plate 21 and the magnet 22 are annularly formed so as to respectively have, in a center thereof, through holes 21K and 22K through which the voice coil bobbin 15 passes. These through holes 21K and 22K form the hole part 17K (see FIG. 2) of the magnetic circuit section 17.

Hereinafter, in order to easily distinguish between the through holes 21K and 22K, the through hole 21K which is provided on the plate 21 is represented as a plate through hole 21K, and the through hole 21K which is provided on the magnet 22 is represented as a magnet through hole 22K.

The magnet through hole 22K is a through hole having a larger diameter than the plate through hole 21K. In addition, the magnet 22 integrally includes groove parts 22M (magnet wiring holes) that are recessed on an outer peripheral side at predetermined angular intervals (at 90 degree intervals in the present configuration) from the magnet through hole 22K. These groove parts 22M configure, as shown in FIG. 3, paths through which each pair of the coated electric wires 52 can pass. It should be noted that these groove parts 22M are partially formed on the magnet 22; and therefore, they hardly affect the performance of the loudspeaker 10.

Further, the magnet 22 is a sintered magnet that is manufactured in a publicly known method such as a powder metallurgy method, in which difficulties are involved in obtaining a complicated shape; however, a shape in which the above groove parts 22M are integrally included can be easily prepared.

On the plate 21 and the bottom plate 23, through holes 21A and 23A are respectively formed at positions that communicate with the groove parts 22M when lamination with the magnet 22 is performed. Thus, a path that allows the coated electric wires 52 to penetrate the magnetic circuit section 17 is formed.

Hereinafter, in order to easily distinguish between the through holes 21A and 23A, the through hole 21A is represented as a plate hole part 21A, and the through hole 23A is represented as a bottom plate hole part 23A.

The plate hole part 21A is an independent through hole that does not communicate with the plate through hole 21K on the plate 21, and is provided closer to an outer peripheral surface of the plate 21. Adoption of this configuration allows suppression of the deterioration of a magnetic force that acts on the voice coil bobbin 15, in comparison with a case in which recessed shapes similar to the groove parts 22M of the magnet 22 are provided on an inner side of the plate 21.

In addition, the plate hole part 21A is not open either in a circumferential direction or radial direction of the plate 21 and therefore, restricts the movement of the coated electric wires 52 in the circumferential direction and radial direction. Therefore, it is suitable for positioning of the coated electric wires 52 having flexibility.

On the bottom plate 23, if recessed shapes similar to the groove parts 22M of the magnet 22 are provided, there is a concern that dust and the like may enter a gap between the bottom plate 23 and the voice coil bobbin 15.

In the present configuration, the bottom plate hole part 23A is a notch that is recessed from an outer peripheral surface of the bottom plate 23 to an inner peripheral side; and therefore, entry of dust and the like can be suppressed.

In addition, an outer peripheral side of the bottom plate hole part 23A is open; and therefore, such an effect that the coated electric wires 52 can be easily inserted from an outside can also be expected.

Further, the shapes and positions of the plate hole parts 21A and the bottom plate hole parts 23A can be appropriately changed.

As shown in FIG. 3, the plate hole parts 21A, the groove parts 22M of the magnet 22, and the bottom plate hole parts 23A are provided at the same angular intervals as the plurality of terminal blocks 33 which are provided on the loudspeaker frame 11; and therefore, the coated electric wires 52 can be linearly laid out, thus providing advantages in reduction of wiring length, securing of a wiring arrangement space, and the like.

Thus, the coated electric wires 52 constituting the second conductive bodies 51 are made to penetrate the magnet 22 and thereby, the magnet 22 can be used as a ferrite core that removes a high frequency noise that flows through the second conductive bodies 51.

The impedance Z of a ferrite core is, as shown in the following expression (1), proportional to a cross-sectional area. In addition, the impedance Z is proportional to the second power of the number of windings N (also called as the number of turns) of a signal line to an inner hole and outside of the ferrite core. In addition, it is known that the smaller the inner diameter of the inner hole of a ferrite core, the more the impedance Z increases.

[Expression 1]

$$|Z| \propto \frac{\text{Cross-sectional area}}{\text{Inner diameter}} N^2 \tag{1}$$

The magnet 22 of the loudspeaker 10 is larger in comparison with common ferrite cores; and therefore, a higher noise removal effect than that in common ferrite cores can be expected. In addition, the groove parts 22M are provided in plurality within the magnet 22 and through each of the groove parts 22M, a plurality of the second conductive bodies 51 are passed in a distributed manner; therefore, each of the groove parts 22M can be miniaturized and the reduction of the impedance Z, etc. can be easily suppressed.

As described above, the loudspeaker 10 of the present embodiment includes: the first conductive bodies 41 which are connected to the voice coil 31 and are led out to the outside of the bobbin 15A; and the second conductive bodies 51 which are connected to the first conductive bodies 41 and penetrate the magnet 22. According to this configuration, a high frequency noise that flows through the second conductive bodies 51 can be removed by using the magnet 22 included in the magnetic circuit section 17.

In addition, noises can be removed without adding a ferrite core for noise countermeasures; and therefore, noise countermeasures for the loudspeaker 10 is possible by means of a simple configuration and further, securing a ferrite core arrangement space is unnecessary.

In addition, a signal to be passed through the second conductive bodies 51 is a digital signal; and therefore, countermeasures against a high frequency noise superimposed on the digital signal can be achieved in a vicinity of the loudspeaker. Thus, influences on electronic apparatuses around the loudspeaker 10 can be reduced and also, improvement in the sound quality of the loudspeaker 10 can be expected.

Further, for the second conductive bodies 51 that penetrate the magnetic circuit section 17, the coated electric wires 52 are used; and therefore, an insulating property against parts of the magnetic circuit section 17 can be ensured. Thus, materials, etc. used for the magnetic circuit section 17 are not limited. In addition, around the second conductive bodies 51, a member having a conductive property can be arranged.

Further, the magnet 22 is provided with: the magnet through hole 22K through which the bobbin 15A passes; and the groove parts 22M which are recessed from this through hole 22K to the outer peripheral side and through which the second conductive bodies 51 pass. This allows the second conductive bodies 51 to penetrate, allows an influence on the performance of the loudspeaker 10 to be suppressed, and allows the magnet 22 to be easily manufactured.

In addition, the magnetic circuit section 17 includes the plate 21 and bottom plate 23 that are laminated components which are laminated on the magnet 22; and the second conductive bodies 51 pass through the plate 21 and the bottom plate 23. This eliminates the need to make the second conductive bodies 51 bypass the plate 21 and the bottom plate 23; providing advantages in reduction of wiring length, securing of a wiring arrangement space, and the like.

Further, the plate 21 is provided with: the plate through hole 21K through which the bobbin 15A passes; and the independent plate hole parts 21A which do not communicate with this through hole 21K and through which the second conductive bodies 51 pass. This allows the second conductive bodies 51 to penetrate and allows the reduction of a magnetic force of the plate 21 to be suppressed.

In addition, the bottom plate 23 is provided with, as the bottom plate hole parts 23A through which the second conductive bodies 51 pass, notches which are recessed from an outer peripheral surface of the bottom plate 23 to an inner peripheral side and through which the second conductive bodies 51 pass. This allows the second conductive bodies 51 to penetrate and allows entry of dust, etc. into a gap between the bottom plate 23 and the bobbin 15A to be suppressed.

In addition, the voice coil bobbin 15 includes a multilayer voice coil in which a plurality of the voice coils 31 are provided; and from the voice coil bobbin 15, a plurality of the first conductive bodies 41 which are respectively connected to the voice coils 31 are led out at intervals in a circumferential direction. Further, a plurality of the second conductive bodies 51 which are respectively connected to the first conductive bodies 41 are configured to pass through the magnet 22 at intervals in the circumferential direction of the voice coil bobbin 15. According to this configuration, a number of the first conductive bodies 41 and second conductive bodies 51 can be arranged at intervals in a balanced manner.

Second Embodiment

Figure 4:
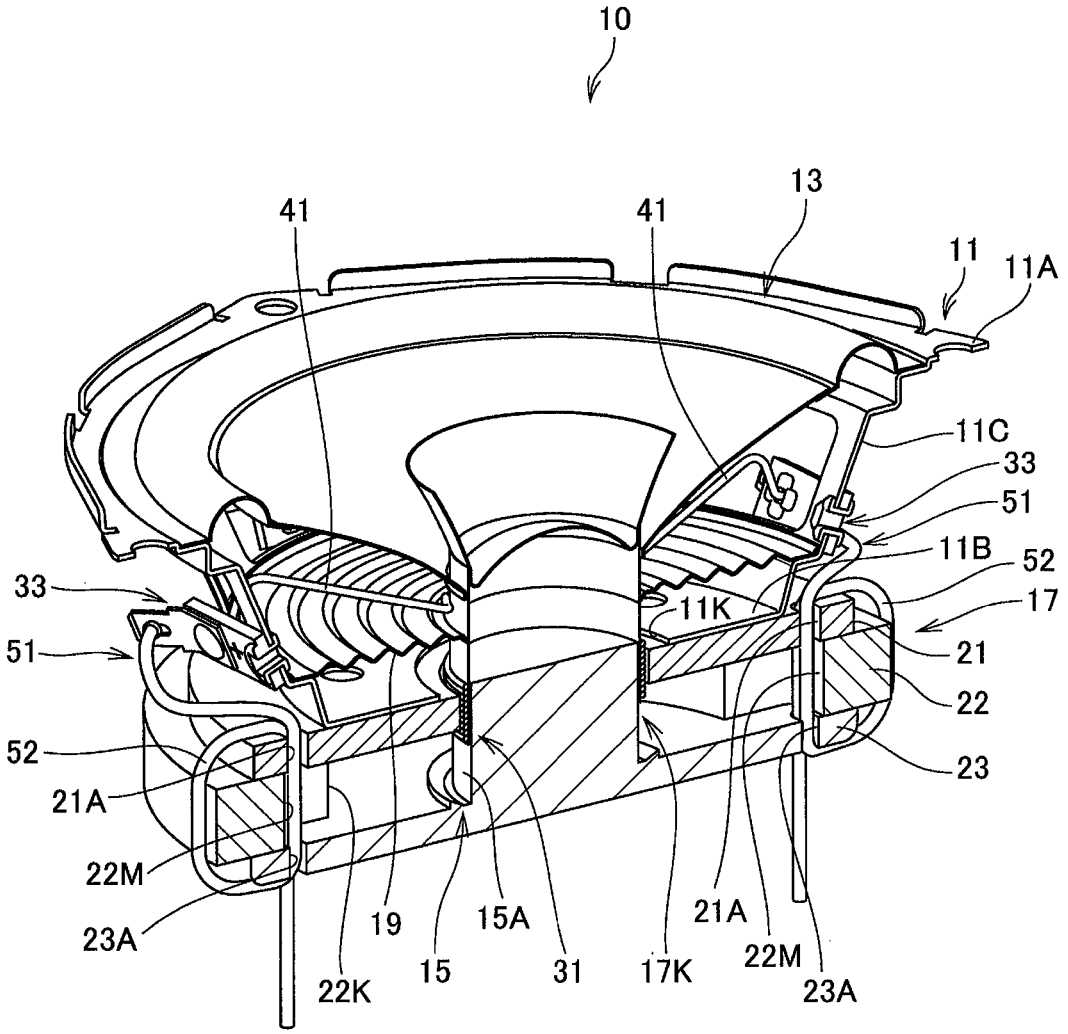
FIG. 4 is a cross-sectional view of a loudspeaker according to a second embodiment.

FIG. 4 is a cross-sectional view of a loudspeaker 10 according to a second embodiment.

As shown in FIG. 4, each of second conductive bodies 51 passes hole parts of a magnetic circuit section 17 (a bottom plate hole part 23A, groove part 22M, and plate hole part 21A) in order from an outside of the loudspeaker 10; after that, returns to a rear surface side of the magnetic circuit section 17 by passing through an outer peripheral side of the magnetic circuit section 17; and again, passes through the hole part 23A, 22M, and 21A of the magnetic circuit section 17 in order and is then connected to each of terminal blocks 33.

As a result, the second conductive body 51 is wound around a magnet 22 in the number of windings with one turn. An increase in the number of windings can increase the impedance Z, thereby allowing a noise removal characteristic to be changed and a noise removal effect to be improved. It should be noted that the number of windings is not limited to one turn and may be appropriately changed to two or more turns.

In a configuration in which the second conductive bodies 51 are wound, increasing a tension in winding the second conductive bodies 51 enables the magnetic circuit section 17 to be bound. Binding the magnetic circuit section 17 enables a holding force for holding components of the magnetic circuit section 17 in a laminated state to be obtained.

Here, in the present embodiment, the bottom plate hole parts 23A are not notches that are recessed from an outer peripheral surface of the bottom plate 23 to an inner peripheral side; but are formed as independent through holes as with the plate hole parts 21A of the first embodiment. This allows the bottom plate 23 in addition to the plate 21 and the magnet 22 to be held in a laminated state by the second conductive bodies 51.

According to this configuration, a configuration in which an adhesive for joining the plate 21, the magnet 22, and the bottom plate 23 with each other is not used is made possible. By adopting a configuration in which an adhesive is not used, the layer thickness of an adhesive is eliminated and thereby the magnetic force of the magnetic circuit section 17 can be efficiently improved.

Third Embodiment

Figure 5:
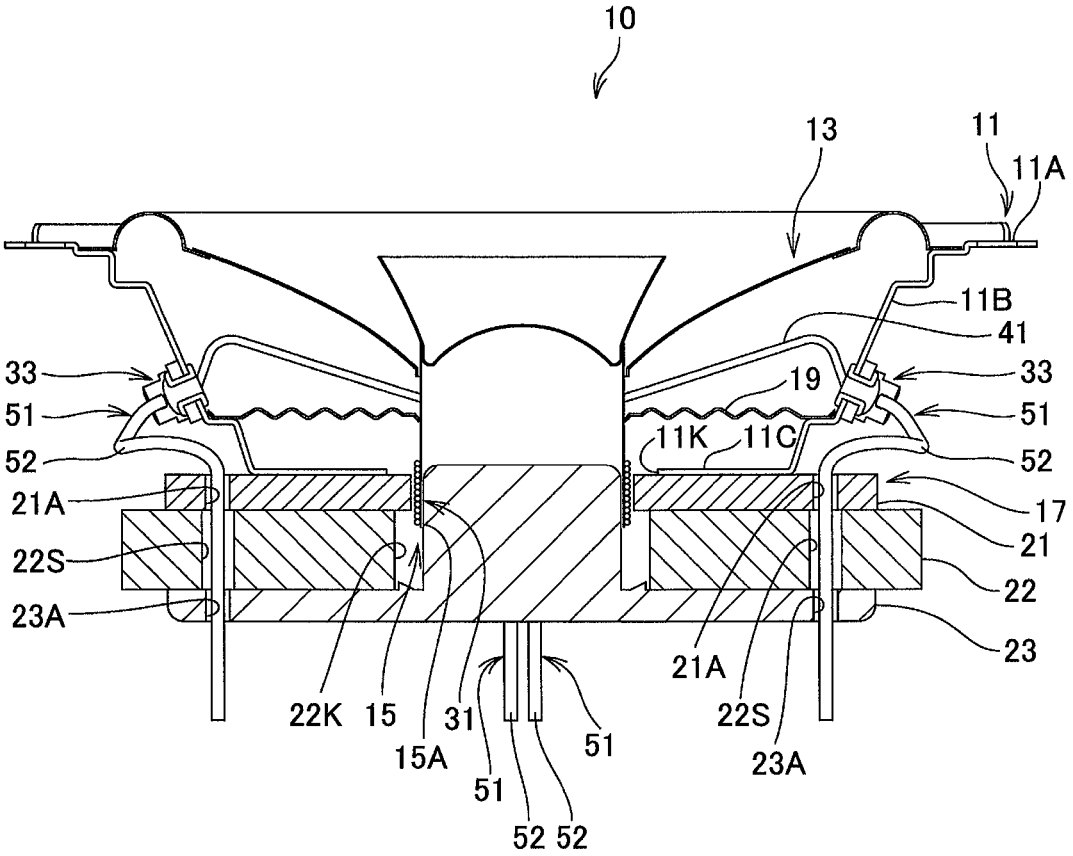
FIG. 5 is a cross-sectional view of a loudspeaker according to a third embodiment.

FIG. 5 is a cross-sectional view of a loudspeaker 10 according to a third embodiment.

The third embodiment is different from the first embodiment in that portions through which second conductive bodies 51 pass on a magnet 22 are hole parts 22S (hereinafter, represented as magnet wiring holes 22S) which are independent of a magnet through hole 22K.

Each of the magnet wiring hole 22S is formed as a through hole that linearly penetrates the magnet 22 so as to communicate with a plate hole part 21A and a bottom plate hole part 23A. The magnet wiring holes 22S are formed at intervals (equal angular intervals) in the circumferential direction of the loudspeaker 10 as with the plate hole parts 21A and the bottom plate hole parts 23A.

In this configuration, the inner diameter of each of the hole parts through which the second conductive bodies 51 pass (that is, the inner diameter of each of the magnet wiring holes 22S) can be reduced and thereby, as shown in Expression (1), the impedance Z can be increased. In addition, as the hole part is made smaller, the cross-sectional area of the magnet 22 increases; this also allows an increase in the impedance Z. As a result, a higher noise removal effect can be obtained and a noise removal characteristic can be changed.

Figure 6:
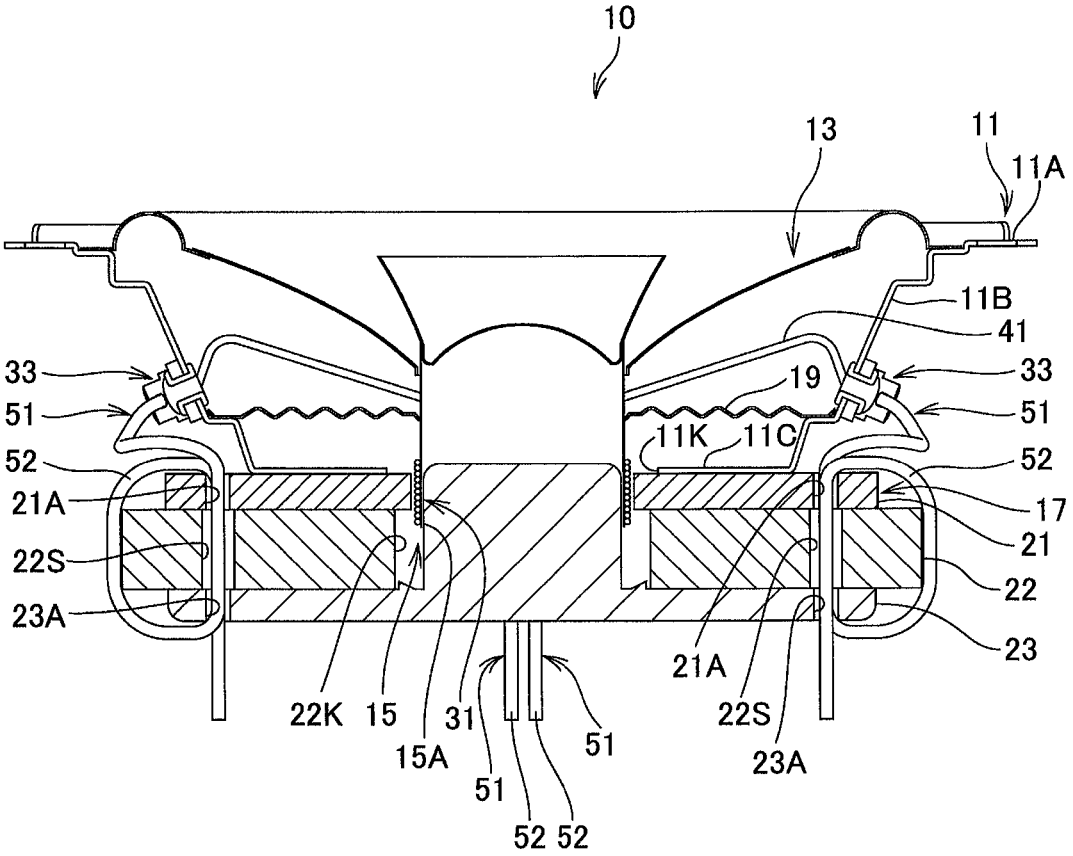
FIG. 6 is a cross-sectional view of a loudspeaker which is provided for description of a modification.

In addition, also in the third embodiment, as one example is shown in FIG. 6, the second conductive bodies 51 can be wound around the magnet 22 in the number of windings with a plurality of turns.

Fourth Embodiment

In a fourth embodiment, a configuration is such that coated electric wires 52 are not allowed to penetrate a magnet 22.

Figure 7:
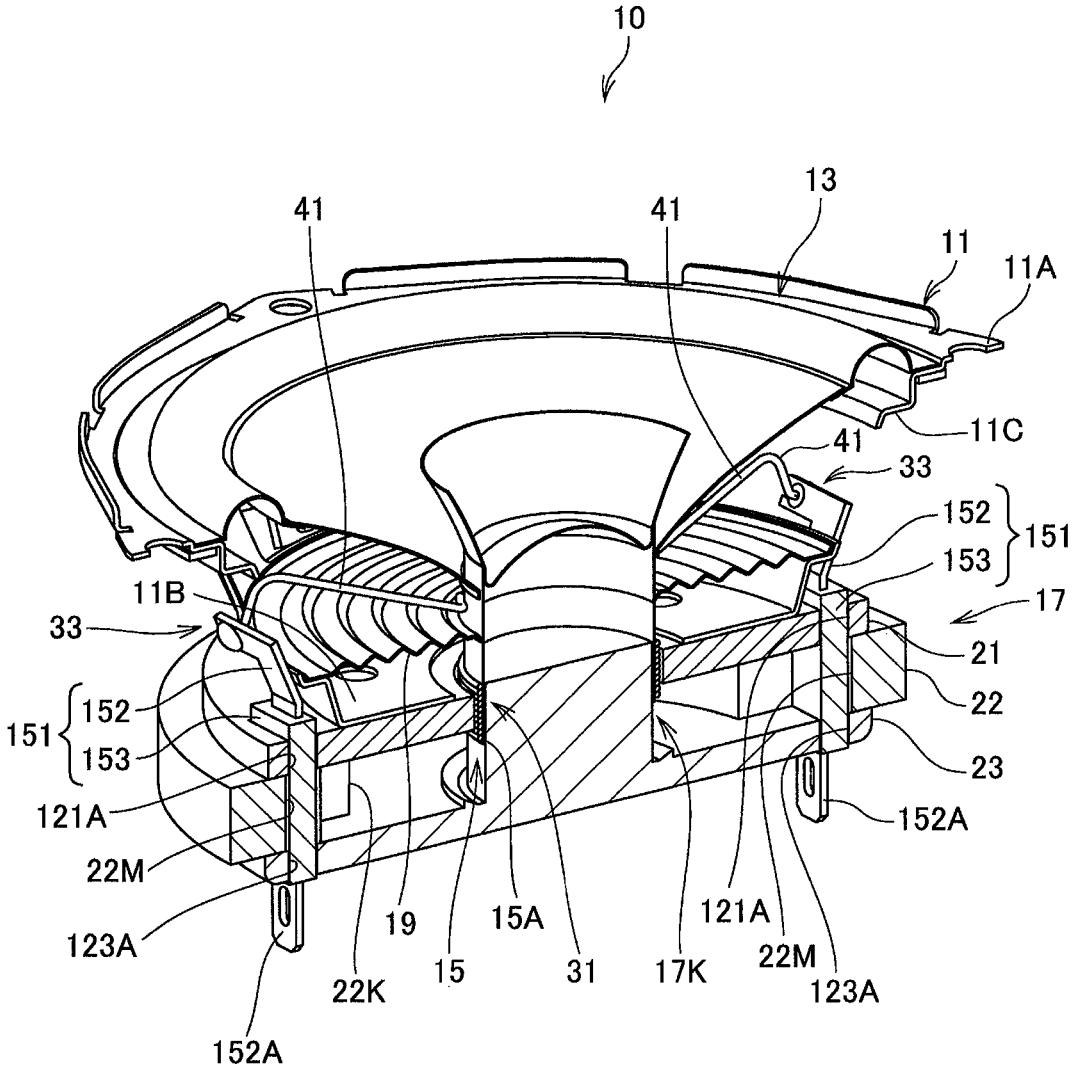
FIG. 7 is a cross-sectional view of a loudspeaker according to a fourth embodiment.

FIG. 7 is a cross-sectional view of a loudspeaker 10 according to the fourth embodiment. In addition, FIG. 8 is a diagram showing the loudspeaker 10 in a state in which components of a magnetic circuit section are separated.

In the fourth embodiment, a terminal block 33 which is provided on a loudspeaker frame 11 integrally includes a second conductive body 151 that penetrates a magnetic circuit section 17. The second conductive body 151 integrally includes: a terminal 152 that is formed integrally with the terminal block 33 and extends toward a rear surface side of the loudspeaker 10; and an insulating part 153 for peripheral covering with a tip of the terminal 152 exposed.

The terminal 152 is formed of a material having conductivity such as metal, and is formed to have a length which allows a tip 152A to penetrate the magnetic circuit section 17 and to be exposed to a rear surface side of the magnetic circuit section 17. The insulating part 153 is formed of a resin having an insulating property, and covers a region overlapping with the magnetic circuit section 17 on the terminal 152. For example, this second conductive body 151 is manufactured by performing insert molding of the terminal 152 on the resin constituting the insulating part 153.

Figure 8:
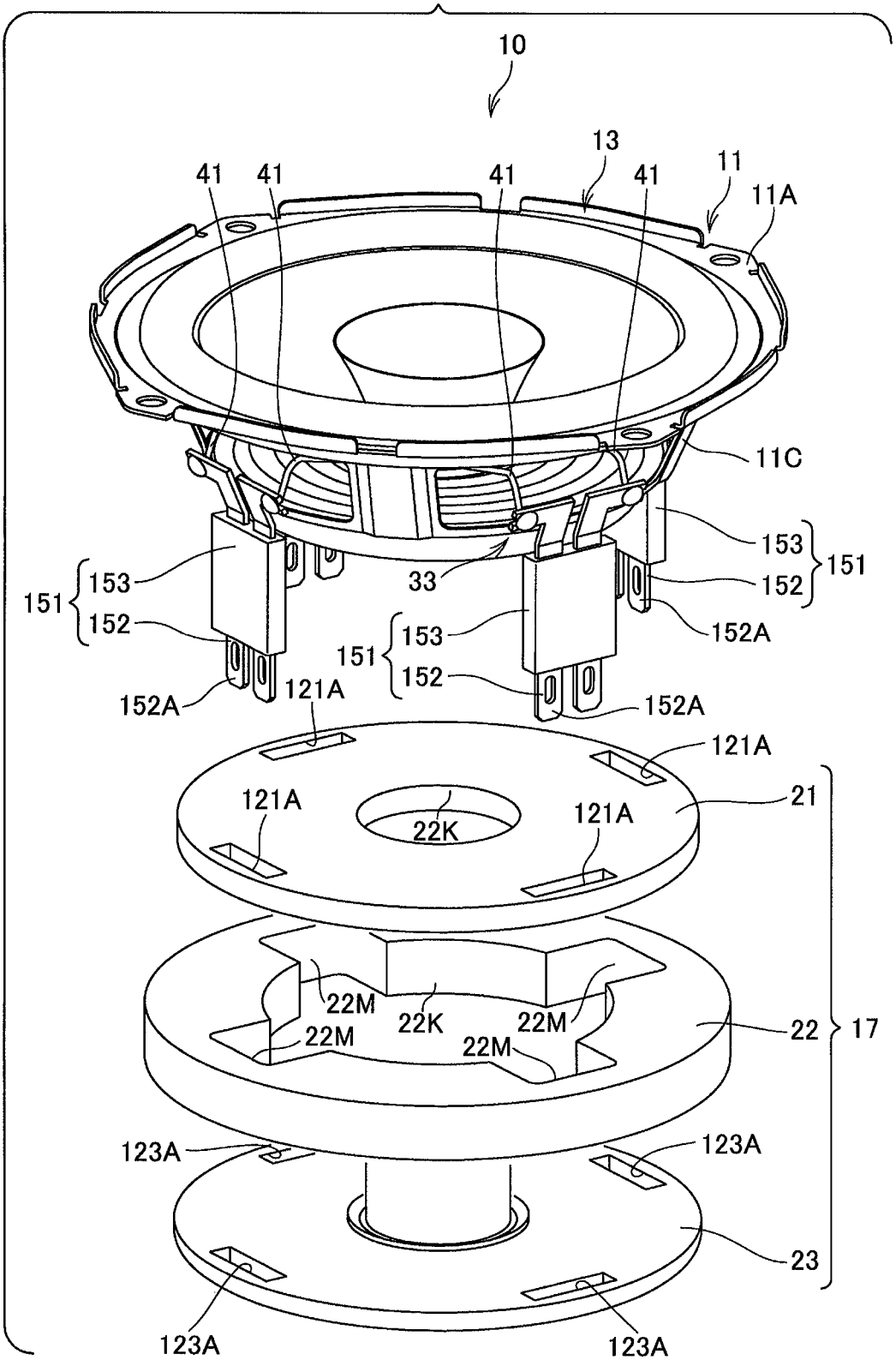
FIG. 8 is a diagram showing the loudspeaker in a state in which components of the magnetic circuit section are separated.

As shown in FIG. 8, on a plate 21 and a bottom plate 23, through holes 121A and 123A (hereinafter, represented as a plate hole part 121A and a bottom plate hole part 123A) which the second conductive body 151 penetrates are respectively formed. The plate hole part 121A and the bottom plate hole part 123A communicate with a groove part 22M that is provided on a magnet 22.

In the fourth embodiment, as shown in FIG. 7, the second conductive body 151 penetrates the magnetic circuit section 17 and thereby, the tip 152A of the terminal 152 which is provided on the second conductive body 151 is exposed to the rear surface side of the magnetic circuit section 17. Further, to this exposed tip 152A, an unillustrated coated electric wire for transmitting a digital signal is connected.

This allows the coated electric wire to be connected to a loudspeaker 10 side without passing through the magnet 22, allowing a work of soldering the coated electric wire to be easily performed. It should be noted that a method for connecting the coated electric wire to the terminal 152 is not limited to soldering and a publicly known connection method can be widely applied.

Each of the above-mentioned embodiments merely exemplifies one aspect of the present invention, and arbitrary modification and application are possible without departing from the spirit of the present invention.

For example, for the first conductive bodies 41 and second conductive bodies 51 and 151, a member permitting an electric signal to pass, that is, a member having conductivity (also called as a conductive member or a conductive body) can be widely applied. However, it is preferable that the first conductive bodies 41 have flexibility. In addition, although each of the second conductive bodies 51 and 151 in the above mentioned embodiments integrally includes an insulating body (coating, corresponding to the insulating part 153), the insulating body may be configured so as to be mounted not on each of second conductive bodies 51 and 151 sides but on a side of a member with which each of the second conductive bodies 51 and 151 can come into contact.

Further, description has been made regarding a case in which the present invention is applied to the loudspeaker 10 that outputs a sound based on a digital signal; however, not limited to this, application to a loudspeaker that outputs a sound based on an analog signal may be possible. Still further, also for the configuration of each part of the loudspeaker, the configurations of publicly known loudspeakers can be widely applied.

REFERENCE SIGNS LIST

10 loudspeaker
11 loudspeaker frame
13 diaphragm
15 voice coil bobbin
15A bobbin
17 magnetic circuit section
17K hole part
21 plate (laminated component)
21A plate hole part
21K plate through hole
22 magnet
22K magnet through hole
22M groove part
22S magnet wiring hole
23 bottom plate (laminated component)
23A bottom plate hole part
31 voice coil
33 terminal block
41 first conductive body
51, 151 second conductive body
52 coated electric wire
152 terminal
153 insulating part

The invention claimed is:

1. A loudspeaker, comprising:
a bobbin provided with a voice coil;
a diaphragm connected to the bobbin;
a frame supporting the diaphragm; and
a magnetic circuit section including a magnet, wherein
the loudspeaker further comprises:
a first conductive body connected to the voice coil and led out to an outside of the bobbin; and
a second conductive body connected to the first conductive body and penetrating the magnet.

2. The loudspeaker according to claim 1, wherein
the second conductive body is a coated electric wire covered with a coating having an insulating property.

3. The loudspeaker according to claim 1, wherein
the second conductive body is wound around the magnet in a number of windings with one or more turns.

4. The loudspeaker according to claim 1, wherein
the magnet is provided with:
a through hole, the bobbin passing through the through hole; and
a groove part recessed from the through hole to an outer peripheral side, the second conductive body passing through the groove part.

5. The loudspeaker according to claim 1, wherein
the magnet is provided with:
a through hole, the bobbin passing through the through hole; and
a hole part independent of the through hole, the second conductive body passing through the hole part.

6. The loudspeaker according to claim 1, wherein
the magnetic circuit section includes a laminated component being laminated on the magnet, and the second conductive body penetrates the laminated component.

7. The loudspeaker according to claim 6, wherein
the laminated component includes:
a plate laminated on a front surface side of the loudspeaker with respect to the magnet; and a bottom plate laminated on a rear surface side of the loudspeaker, the plate is provided with:

a hole part, the bobbin passing through the hole part, and an independent through hole not communicating with this hole part, the second conductive body passing through the through hole, and the bottom plate is provided with a notch recessed from an outer peripheral surface of the bottom plate to an inner peripheral side, the second conductive body passing through the notch.

8. The loudspeaker according to claim 1, wherein a signal passing through the second conductive body is a digital signal.

9. The loudspeaker according to claim 1, wherein the bobbin includes a multilayer voice coil provided with a plurality of the voice coils;

from the bobbin, a plurality of the first conductive bodies respectively connected to the voice coils are led out at intervals in a circumferential direction; and a plurality of the second conductive bodies respectively connected to the first conductive bodies pass through the magnet at intervals in the circumferential direction of the bobbin.

* * * * *